US007617623B1

(12) United States Patent
Goldberg

(10) Patent No.: US 7,617,623 B1
(45) Date of Patent: Nov. 17, 2009

(54) WINE BADGE IDENTIFICATION SYSTEM

(76) Inventor: Jay L. Goldberg, P.O. Box 21115, Castro Valley, CA (US) 94546

( * ) Notice: Subject to any disclaimer, the term of this patent is extended or adjusted under 35 U.S.C. 154(b) by 30 days.

(21) Appl. No.: 12/133,727

(22) Filed: Jun. 5, 2008

(51) Int. Cl.
*G09F 3/00* (2006.01)

(52) U.S. Cl. ..... 40/310; 40/306; 40/638

(58) Field of Classification Search ..... 40/310, 40/305, 306, 307, 311, 642.02, 660, 661.05; 215/365–367, 14, 386, 370, 376
See application file for complete search history.

(56) References Cited

U.S. PATENT DOCUMENTS

| | | | | | |
|---|---|---|---|---|---|
| 1,209,998 | A * | 12/1916 | Pinckert | ..... | 40/27.5 |
| 2,141,722 | A * | 12/1938 | Morgan | ..... | 40/311 |
| 2,888,159 | A * | 5/1959 | Fields | ..... | 215/230 |
| 3,204,359 | A * | 9/1965 | Kurokawa | ..... | 40/307 |
| 4,559,730 | A * | 12/1985 | Burrell | ..... | 40/324 |
| 5,992,073 | A * | 11/1999 | Wolpa | ..... | 40/651 |
| 6,023,865 | A * | 2/2000 | Preuss | ..... | 40/310 |
| 6,321,473 | B1 * | 11/2001 | Klabunde | ..... | 40/310 |
| 6,378,906 | B1 * | 4/2002 | Pennaz | ..... | 283/81 |
| 6,594,928 | B1 * | 7/2003 | Clawson et al. | ..... | 40/310 |
| 6,868,627 | B2 * | 3/2005 | Elias | ..... | 40/306 |
| D595,924 | S * | 7/2009 | Haynes | ..... | D99/34 |

* cited by examiner

*Primary Examiner*—Lesley D Morris
*Assistant Examiner*—Shin Kim
(74) *Attorney, Agent, or Firm*—Steven A. Nielsen; Allman & Nielsen, P.C.

(57) ABSTRACT

A system for marking bottles to be stored in horizontal or tilted positions uses durable and reusable components to secure user created labels to the top or bottom of bottles, such as wine bottles. A badge is used for marking insignia helpful to the user in locating and/or identification of the bottle. The badge may be inserted into a badge holder that contains the badge and prevents the badge from rotating within the badge holder. For bottles stored with the tops facing the user, the badge holder is secured to the top of the bottle. For bottles stored with the bottoms facing the user, the badge holder is secured to a bottle bottom adaptor that fastens to the bottom of a bottle.

9 Claims, 8 Drawing Sheets

WINE BADGE IDENTIFICATION SYSTEM

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING

Not Applicable

BACKGROUND OF THE INVENTION

Field of the Invention

The invention generally relates to means and methods of marking or labeling bottles and other containers. More particularly, the invention relates to means and methods of reusable identification attachments for beverage bottles, such as wine bottles.

BRIEF SUMMARY OF THE INVENTION

The present invention provides unexpected results by providing economical, reusable, secure and versatile means of tagging or marking containers, including, but not limited to, wine bottles. Wine and other bottled beverages are typically stored in horizontal or tilted positions to keep the cork moist. Bottles are staggered bottom out and front out to conserve storage space. Unfortunately, most beverage manufacturers attach labels and other insignia on the vertical sides of the bottle as most bottled products are displayed for sale in a vertical position. Thus, there is a need in the art for means of identifying the contents of bottles when such bottles are stored in traditional fashion, such as horizontally, in a wine rack.

The invention provides a system and means of displaying the contents of products. The disclosed invention and/or parts of the disclosed invention are sometimes referred to as "Reveal Your Wine™", "The Wine Badge"™, "The Wine Badge System"™, the "wine badge system" the "invention", the "system" or the "present invention."

Wine Badge Insert or Badge

The disclosed Wine Badge insert, insert, badge insert, circular marking label or badge is comprised of paper or other material suitable for marking. The badge may be circular in shape with one "V" notch at the perimeter. The "V" notch assists in preventing the badge from rotating when placed in the disclosed badge holder. The disclosed badge may be color coded to correspond to white wine or red wine, may have three or more centered lines to assist in inscription of identifying information. The badge may be of minimal thickness to assist in insertion into the badge holder.

Wine Badge Holder or Badge Holder

The disclosed Wine Badge holder or badge holder is circular in shape, has means of internally receiving a badge, and has a "V" notch complementary to the "V" notch in the badge. The badge holder has an open face capable of displaying an inserted badge and has a solid backing with means of securing a fastener, such as Velcro. The badge holder may be secured to the top of a bottle or with use of the disclosed bottle bottom adapter, secured to the bottom of a bottle.

Wine Badge Clip or Clip

The disclosed Wine Badge clip or clip has means of attachment to the back of the badge holder. The clip also has means of attachment to the disclosed bottle bottom adaptor. The clip as a flexible leg and a base. The crossing section of the bottle bottom adaptor may be fitted between the clip's flexible leg and base. The bottom side of the clip base may be fitted with a Velcro attachment.

Wine Badge Bottle Bottom Adapter or Bottle Bottom Adapter

The disclosed bottle bottom adapter is made of flexible material, has a circular section for attachment to the bottom of a bottle and has crossing section spanning the diameter of the circular section. The disclosed clip may be attached to the crossing section.

The Wine Badge System™ or the Disclosed System

An operator or consumer of the disclosed system may write product information upon the badge. In one embodiment, badges with red or white indicia are provided for use with red wine or white wine. Computer printout paper badges are also contemplated. A portion of the original packaging or labeling on a bottle may be removed and attached to the face of a badge. The badge may provide information of interest to the user and/or information and insignia of interest to a connoisseur or collector of bottled products.

After marking, the badge may be inserted and secured into the badge holder. "V" notches in the badge and badge holder keep the badge from rotating. The badge holder has a beveled outer perimeter section and a solid backing to support an inserted badge. The top center portion of the badge holder may be covered with a clear element or left uncovered. The back of the badge holder may have a piece of Velcro attached to the center. For use with bottles stored with the tops exposed, a small circular Velcro piece may be applied to the top of the bottle. The back of the badge holder may be secured to the top of the bottle with a Velcro interface or similar means.

The system achieves unexpected results by the versatility of the badge holder, clip and bottle bottom adaptor that accommodates both bottle tops and bottle bottoms. The same badge and badge holder used in a bottle top application may also be used in a bottle bottom application. The use of the disclosed bottle bottom adapter allows the badge and badge holder to be seamlessly secured to the bottom of a bottle. The disclosed clip or clip system quickly secures the badge holder to the bottle bottom adapter. After use of the bottle, the bottle bottom adapter may be removed and reused as well as the badge holder.

These and other objects and advantages will be made apparent when considering the following detailed specification when taken in conjunction with the drawings.

DETAILED DESCRIPTION OF THE INVENTION

Figure 1:
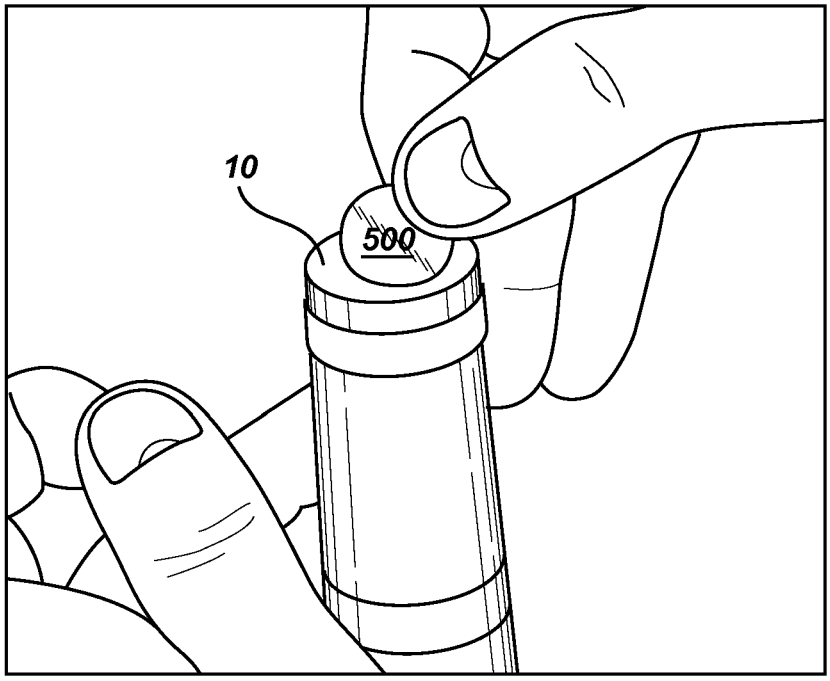
FIG. 1 is a perspective view of the application of a bottle top Velcro attachment.

In the following description, for purposes of explanation, numerous specific details are set forth in order to provide a thorough understanding of the invention. It will be apparent, however, to one skilled in the art that the invention can be practiced without these specific details. In other instances, structures and devices are shown in block diagram form in order to avoid obscuring the invention.

The reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment nor are separate alternative embodiments mutually exclusive of other embodiments.

In the following detailed description of embodiments of the invention, reference is made to the accompanying drawings in which like references indicate similar elements, and in which is shown by way of illustration specific embodiments in which the invention may be practiced. These embodiments are described in sufficient detail to enable those skilled in the art to practice the invention, and it is to be understood that other embodiments may be utilized and that logical, mechanical, electrical, functional, and other changes may be made without departing from the scope of the present invention. The flowing detailed description is, therefore, not to be taken in a limiting sense.

The description, which follows, and the embodiments described therein, are provided by way of illustration of an example, or examples of particular embodiments of the principles of the present invention. These examples are provided for the purposes of explanation, and not of limitation, of those principles of the invention. In the description, which follows, like parts are marked throughout the specification and the drawings with the same respective reference numerals. The drawings are not necessarily to scale and in some instances proportions may have been exaggerated in order to more clearly depict certain features of the invention.

REFERENCE NUMBERS

Figure 2:
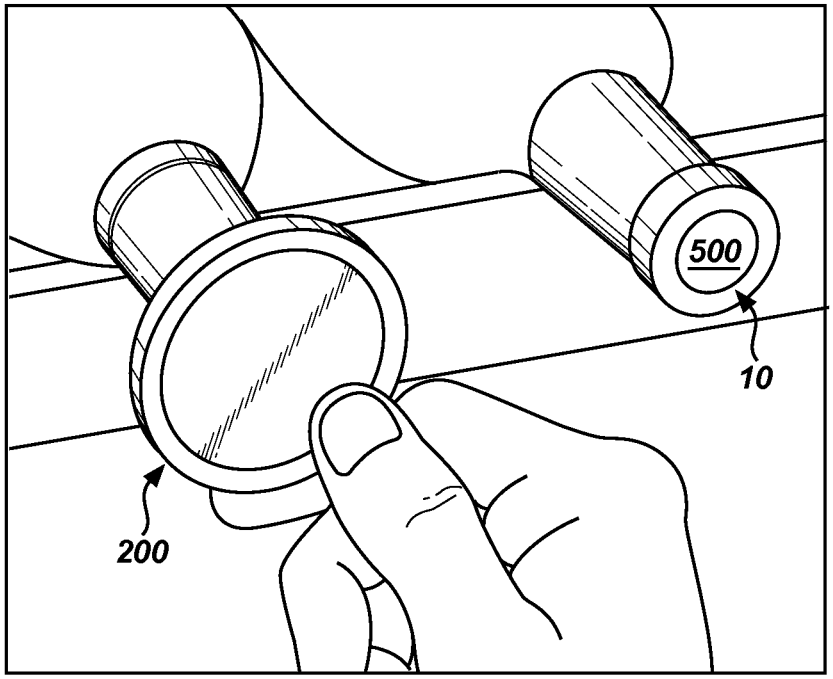
FIG. 2 is a perspective view of the application of a badge holder to the top of a bottle.

10 bottle top section of bottle
11 bottom of bottle
12 vertical side of bottle
13 typical label applied to the vertical side of a bottle
100 bottle bottom adapter assembly
102 circular section of bottle bottom adaptor
103 crossing section of bottle bottom adaptor
200 badge holder assembly
201 top ring surface of badge holder
202 outer beveled surface of badge holder
203 top side of backing surface of badge holder
204 back side of backing surface of badge holder or back side of badge holder
205 circular recessed area on back side of badge holder or back side of backing surface of badge holder
206 outer area or void area of "V" notch on back side of badge holder
207 void in sidewall of badge holder, used for receiving badge
208 solid sidewall area of badge holder
209 "V" notch shape within perimeter of back side of badge holder
300 badge or insert
301 optional writing lines on badge
305 "V" notch shape of outer edge of badge
306 outer "V" notch void at outer edge of badge
400 clip assembly
401 Velcro attachment on bottom side of clip base
402 base of clip or clip base
403 flexible leg of clip
500 bottle top Velcro attachment Referring to FIG. 1, a consumer or user of the disclosed system is shown applying a bottle top Velcro attachment 500 to a bottle top section 10 of a bottle. Velcro attachment 500 may attach to the back side of badge holder assembly 200. In FIG. 2 a user is shown affixing a badge holder to the top of a bottle.

Figure 3:
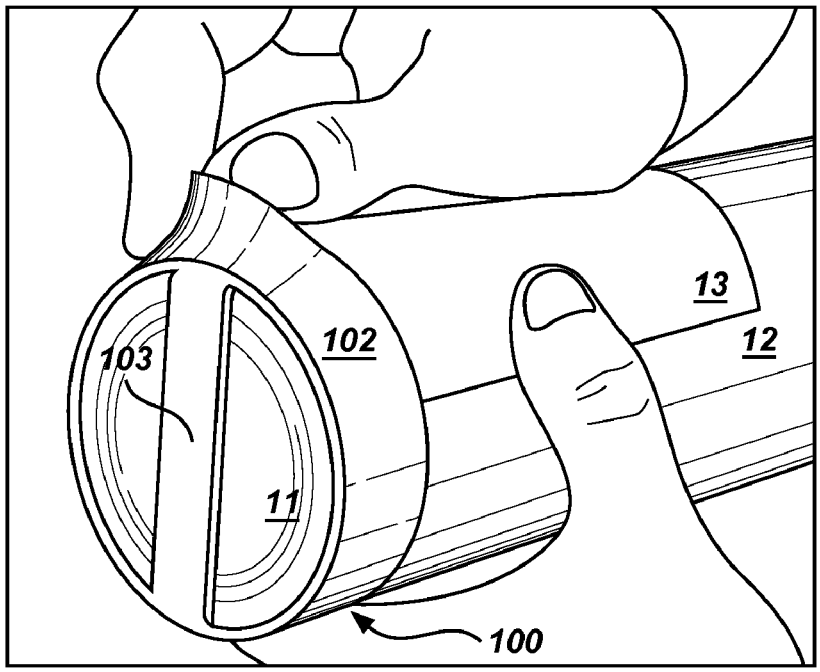
FIG. 3 is a perspective view of the application of a bottle bottom adapter to the bottom of a bottle.
Figure 4:
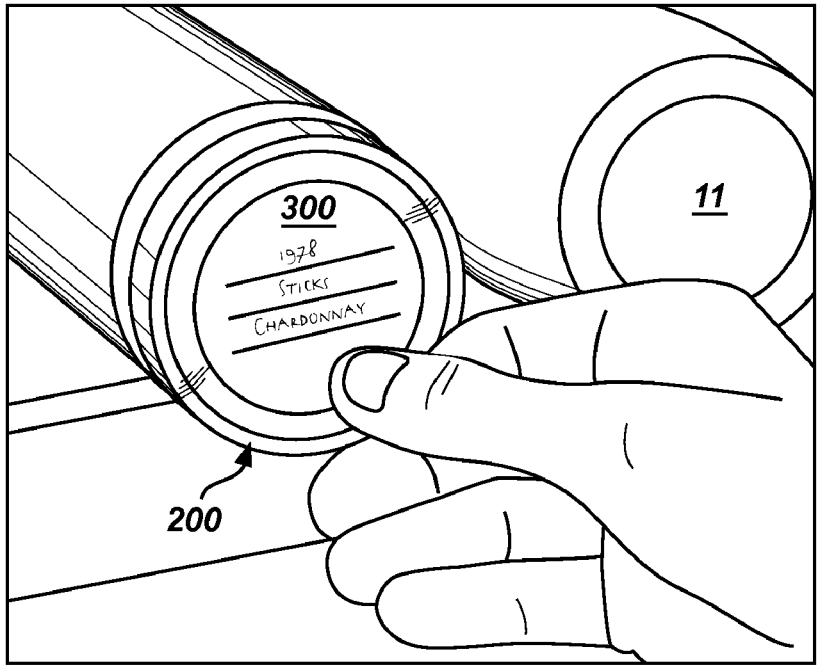
FIG. 4 is a perspective view of the application of a badge holder and badge to a bottle bottom adapter.

In FIG. 3 bottle bottom adaptor assembly 100 is shown being attached to the bottom of a bottle 11. A typical bottle label 13 is shown on the vertical side 12 of the bottle. The bottle bottom adaptor assembly 100 is secured to the bottle by placing the circular section 102 of bottle bottom adaptor around the circumference of the bottle. In FIG. 4 a badge holder 200 with a badge 300 is being secured to a bottle bottom adapter.

Figure 5A:
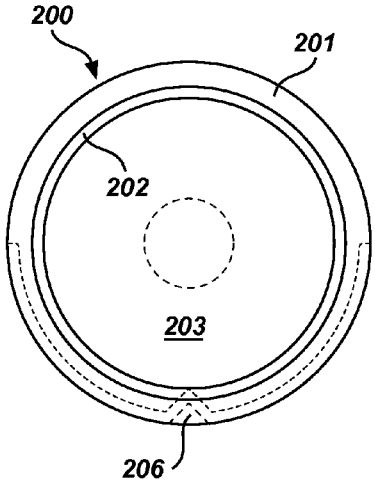
FIG. 5A is a plan view of the top of a badge holder.

FIG. 5A shows the top side of a badge holder 200. The top ring surface 201 of the badge holder spans the entire upper and outer premier of the badge holder. Outer beveled surface 202 of the badge holder joins the top ring surface 201. Outer beveled surface 202 does not touch the top side 203 of the backing surface. The outer area 206 of the V notch on back side of badge holder is shown in dotted lines as the V notch is not visible from the topside of the badge holder.

Figure 5B:
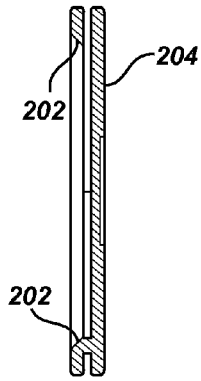
FIG. 5B is an elevation view of the lower side edge of a badge holder.
Figure 5C:
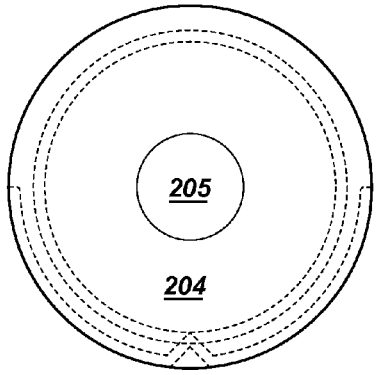
FIG. 5C is a plan view of the bottom side of a badge holder.

FIG. 5B is a cross sectional view of a badge holder showing the outer beveled surfaces at a 45 degree angle. FIG. 5C is a plan view of the bottom side of a badge holder. Back side 204 of the badge holder contains circular recessed area 205. A Velcro attachment piece may be placed within circular recessed area 205, which may fasten to Velcro attachment 401 found on the bottom side of base clip 402. FIG. 5D is a perspective top and side view of a badge holder and shows the outer area 206 of the "V" notch and solid sidewall area 208. Top ring surface 201 supports outer beveled surface 202.

Figure 5E:
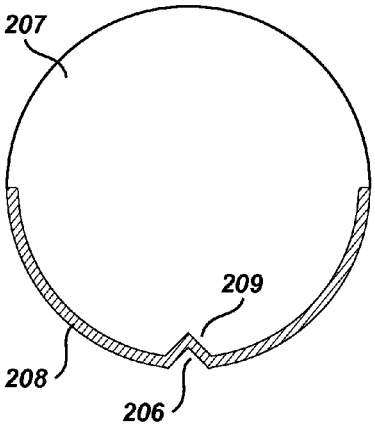
FIG. 5E is a sectional plan view of a badge holder.
Figure 5F:
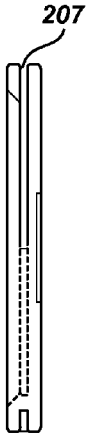
FIG. 5F is an elevation view of a side edge of a badge holder.
Figure 5D:
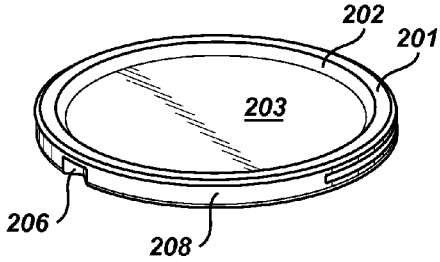
FIG. 5D is a perspective top and side view of a badge holder.
Figure 5G:
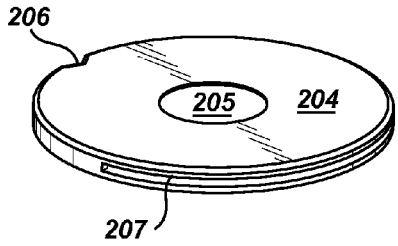
FIG. 5G is a perspective view of the bottom side and side of a badge holder.

FIG. 5E is a sectional plan view of a badge holder and shows outer void area 206 of the "V" notch located on the back side of badge holder. The "V" notch 209 within the perimeter of the back side of the badge holder accepts the "V" notch 305 of the badge. Area 207 is void in the sidewall of the badge holder and is used for receiving a badge. The solid sidewall area 208 of the badge holder supports the top ring surface 201 and the outer beveled surface 202 of the badge holder. FIG. 5F is an elevation view of a side edge of a badge holder and shows sidewall void area 207 that is used for insertion of the badge. FIG. 5G is a perspective view of the bottom side of a badge holder and shows sidewall void area 207 in the foreground and "V" notch area 206 in the left background. Back surface 204 supports center void area 205.

Figure 6:
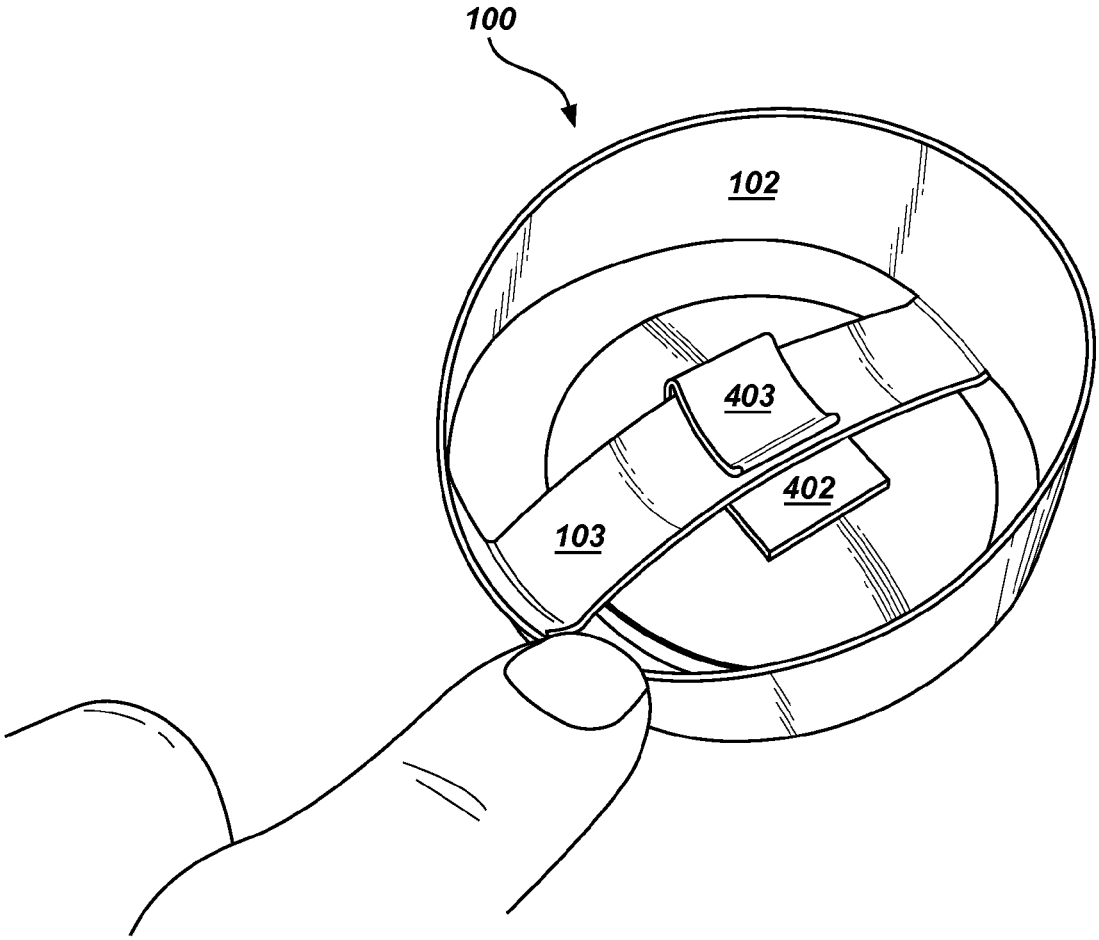
FIG. 6 is a perspective view of the bottle side of a bottle bottom adapter.

FIG. 6 is a perspective view of the bottle side of a bottle bottom adapter 100 with the base of a clip 402 on the bottom side of crossing section 103 and the flexible leg of the clip 403 on the upper or bottle side of crossing section 103. Circular section 102 may be placed around the bottom end of a bottle.

Figures 7A, 7B:
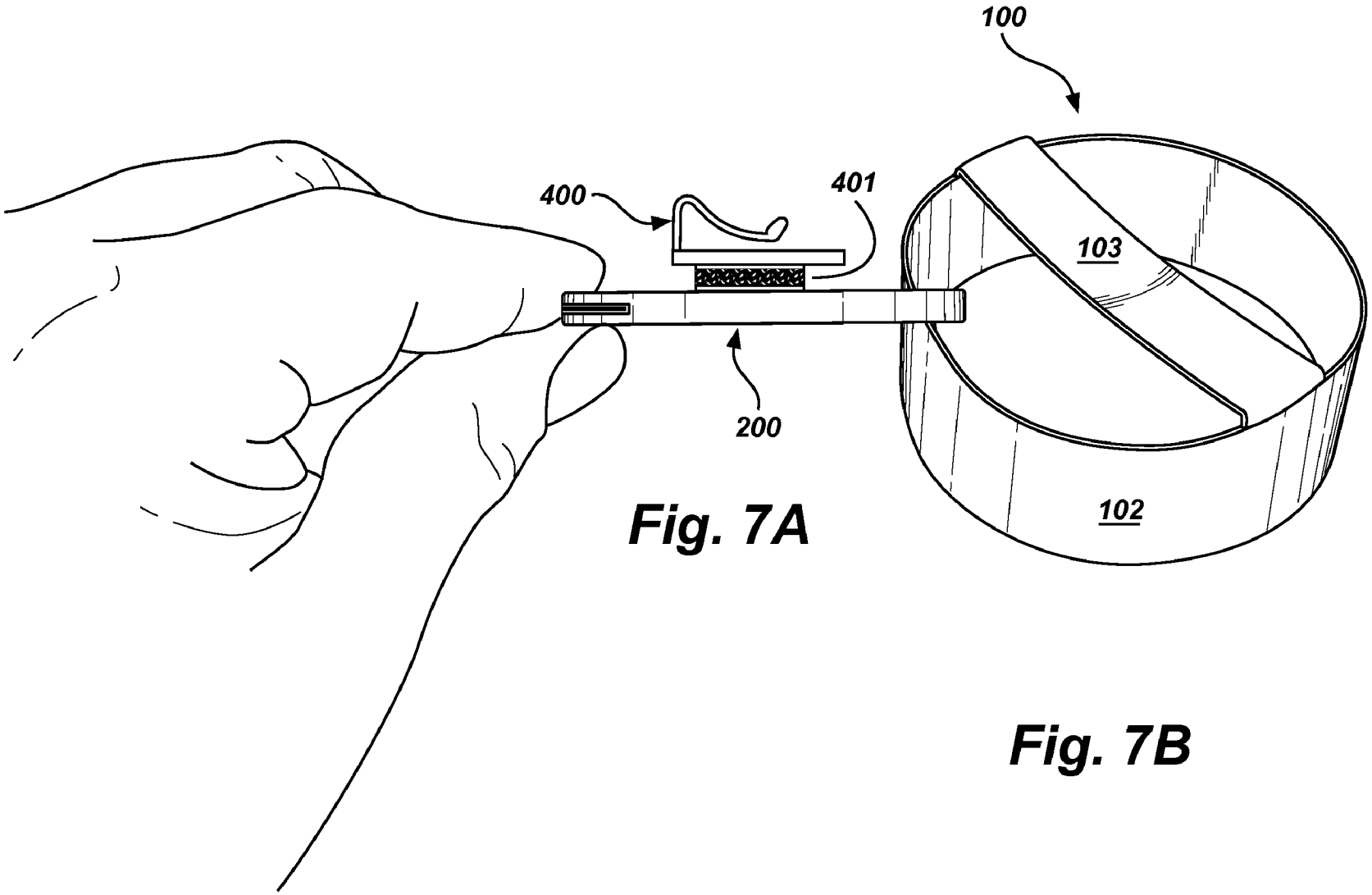
FIG. 7A is an elevation view of a clip, Velcro attachment piece and badge holder.
FIG. 7B is a perspective view of the bottle bottom adaptor, in a bottle side down position.

FIG. 7A is an elevation view of a clip 400, Velcro attachment 401 and badge holder 200. FIG. 7B is a perspective view of the bottle bottom adaptor 100, in a bottle side down position. Circular section 102 supports crossing section 103.

Figure 8C:
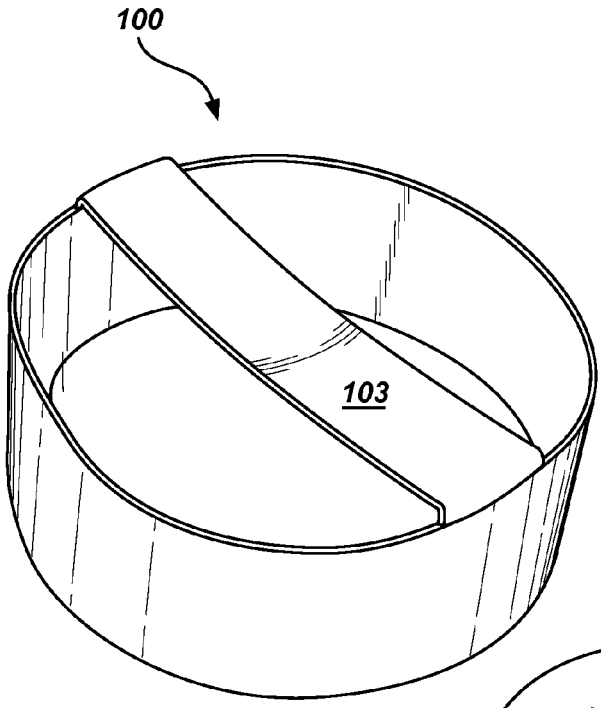
FIG. 8C is a perspective view of bottle bottom adaptor, in a bottle side down position.
Figure 8B:
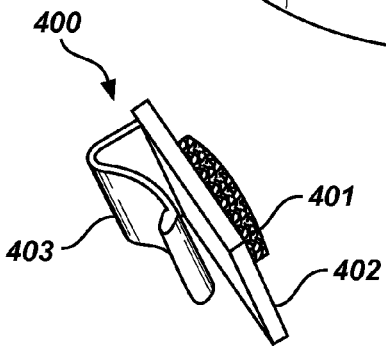
FIG. 8B is a perspective view of a clip.
Figure 8A:
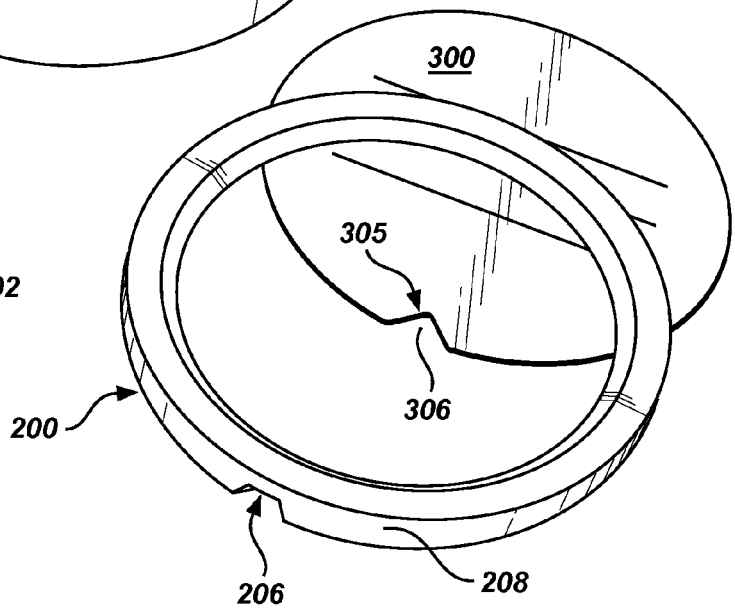
FIG. 8A is a perspective view of a badge being inserted into a badge holder.

FIG. 8A is a perspective view of a badge 300 being inserted into a badge holder 200. The "V" notch shape 305 of the outer edge of the badge and the outer "V" notch 306 void in the badge align with the outer area V notch 206 of the badge holder.

FIG. 8B is a perspective view of a clip 400 with a base 402 secured to a Velcro attachment 401. The flexible leg 403 of the clip may be affixed to the crossing section 103 of the bottle bottom adaptor 100.

Figure 9:
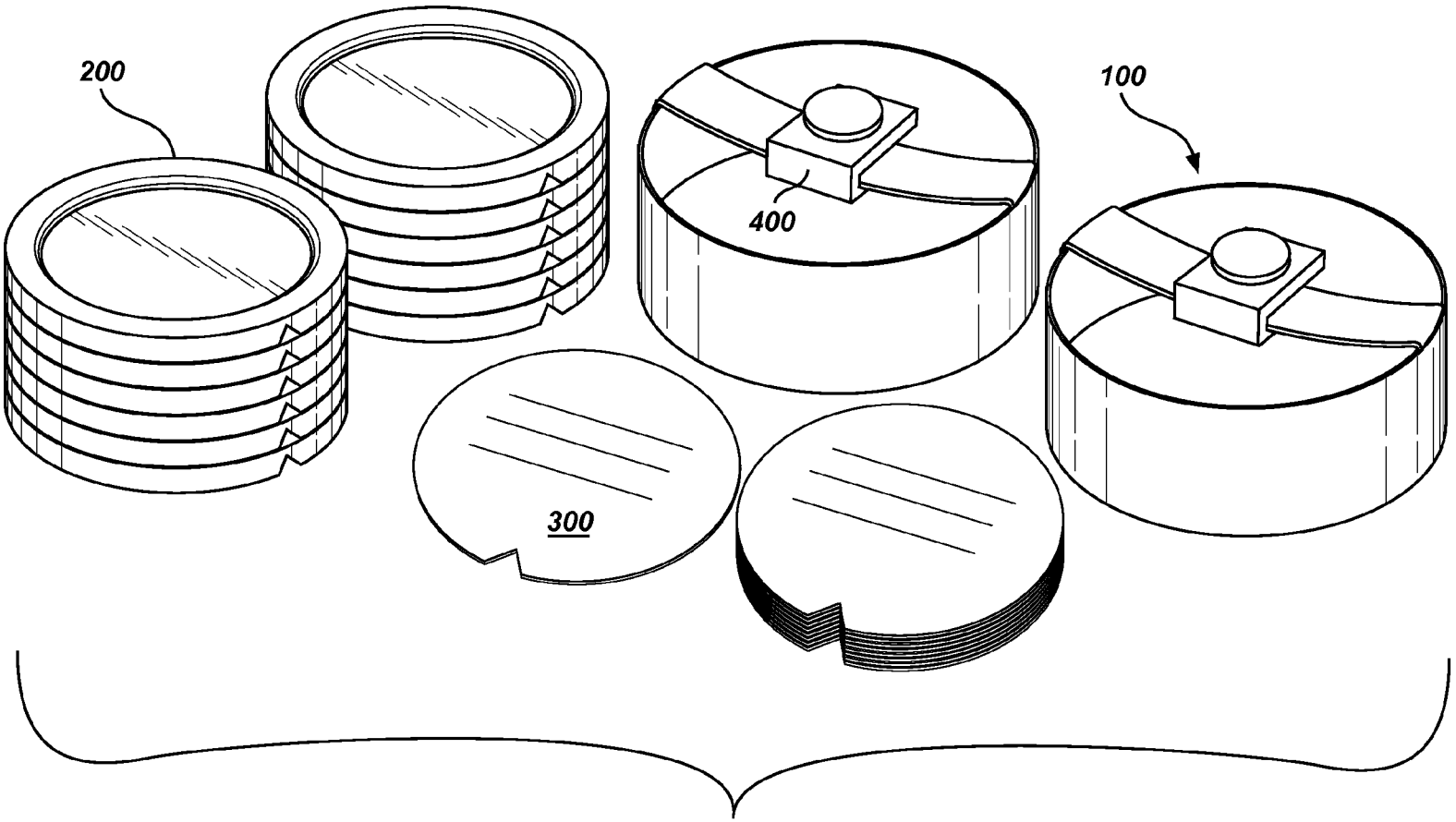
FIG. 9 is a perspective view of various components of the invention in a possible kit configuration.

FIG. 9 is a perspective view of various components of the invention in a possible kit configuration. The system may comprise a kit, comprising a plurality of badge holders 200, badges 300, clips 400 and bottle bottom adaptors 100.

Figure 10:
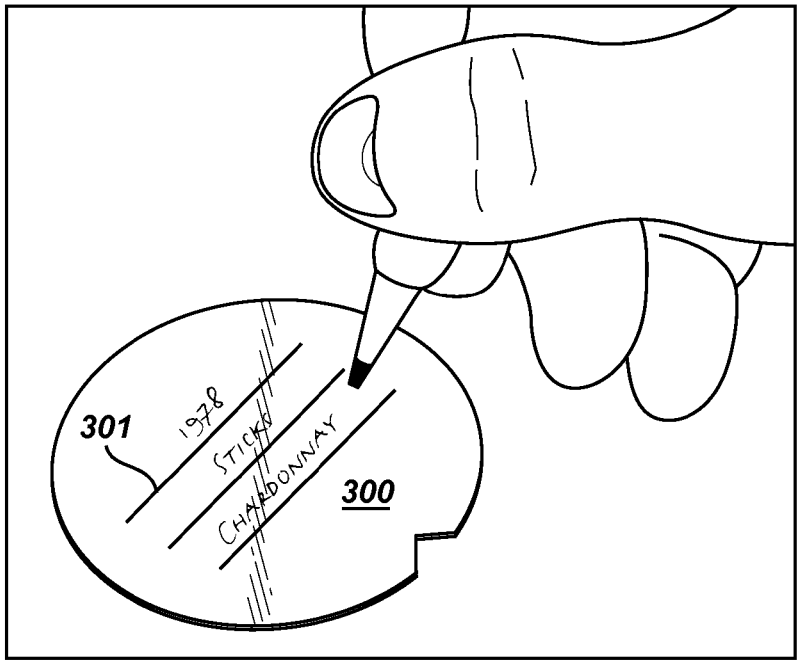
FIG. 10 is a perspective view of a badge being marked.
Figure 11:
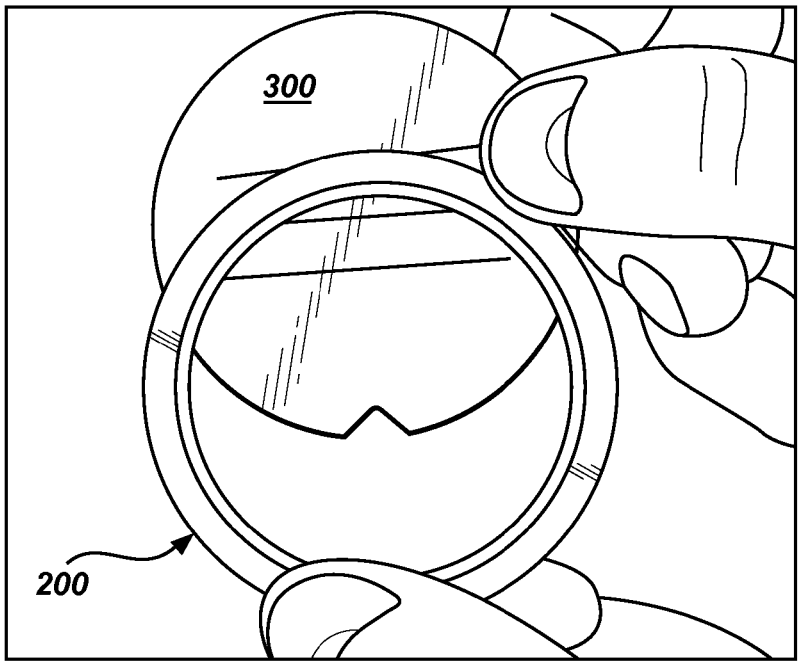
FIG. 11 is a top plan view of a badge being inserted into a badge holder.

FIG. 10 is a perspective view of a badge 300 being marked along optional marking lines 301. FIG. 11 is a top plan view of a badge 300 being inserted into a badge holder 200.

The disclosed system and method are well suited for objects other than bottles. The use of the invention upon other containers is contemplated.

What is claimed is:

1. A method of marking bottles, the method comprising:

a. using a circular badge for writing or labeling, the badge having a "V" notch at the bottom;

b. inserting the circular badge into a badge holder, the badge holder having means of accepting a badge such that the badge may be displayed on one side, and on the other side of the badge holder, means exist for attachment to a bottle top or a clip;

c. using a "V" notch in the badge holder to complement the "V" notch in the circular badge, such that the circular badge is prevented from rotating within the badge holder;

d. for use with bottles stored with the bottom side toward the user:

i. using a bottle bottom adaptor with an elastic circular section suitable for securing to the bottom of a bottle and using a crossing section attached to the circular section of the bottle bottom adaptor to secure a clip, the clip having a flexible leg and base used to attach the clip to the crossing section of the bottle bottom adaptor;

ii. attaching the bottle bottom adaptor to the bottom side of a bottle;

iii. attaching the clip to the crossing section of the bottle bottom adaptor; and iv. attaching the badge holder to the base of the clip;

e. for use with bottles stored with the top side toward the user:

i. applying a fastener to the top of the bottle; and ii. attaching the badge holder to the fastener attached to the top of the bottle.

2. The method of claim 1 using a badge with red indicia to indicate red wine and using a badge with white indicia to indicate white wine.

3. The method of claim 2 using a badge with three centered preprinted lines to assist in marking the badge.

4. A system for marking bottles, the system comprising:

a. a circular badge, suitable for marking and with a "V" notch at the bottom;

b. a circular badge holder with means of accepting the badge, the badge holder having an internal "V" notch complementary to the "V" notch in the badge, sufficient to prevent the badge from rotating when inserted into the badge holder, the badge holder having a top ring surface at the outer circumference and an outer bevel surface attached to the top ring surface such that the bevel surface does not touch a badge resting within the badge holder, the badge holder having a solid sidewall section sufficient to support the top ring surface upon a backing surface, the badge holder having a void between the backing surface and top ring surface sufficient to allow the insertion of the badge;

c. for use with bottles stored with the bottom side out:

i. a bottle bottom adaptor with a circular section used to attach to the bottom of a bottle and a cross section attached to the circular section; and ii. a clip with a base and flexible leg, suitable for attachment upon the cross section of the bottle bottom adaptor and the clip having with a fastener on the back side of the base with means to attach to the back side of the badge holder;

d. for use with bottles stored with the top side out, a fastener with means of attaching to the top of a bottle and means of securing the badge holder to the top of the bottle.

5. The system of claim 4 with Velcro for attachment to the back side of the badge holder and complementary Velcro for attached to the clip or bottle top.

6. A kit for marking bottles to be stored in a horizontal or tilted position, the kit comprising:

a. a circular badge, suitable for marking and with a "V" notch at the bottom;

b. a circular badge holder with means of accepting the badge, the badge holder having an internal "V" notch complementary to the "V" notch in the badge, sufficient to prevent the badge from rotating when inserted into the badge holder, the badge holder having a top ring surface at the outer circumference and an outer bevel surface attached to the top ring surface such that the bevel surface does not touch a badge resting within the badge holder, the badge holder having a solid sidewall section sufficient to support the top ring surface upon a backing surface, the badge holder having a void between the backing surface and top ring surface sufficient to allow the insertion of the badge;

c. for use with bottles stored with the bottom side out:

i. a bottle bottom adaptor with a circular section used to attach to the bottom of a bottle and a cross section attached to the circular section; and ii. a clip with a base and flexible leg, suitable for attachment upon the cross section of the bottle bottom adaptor and the clip having with a fastener on the back side of the base with means to attach to the back side of the badge holder;

d. for use with bottles stored with the top side out, a fastener with means of attaching to the top of a bottle and means of securing the badge holder to the top of the bottle.

7. The kit of claim 6 with Velcro for attachments suitable for the back side of the badge holder and for attached to the clip or to the top of a bottle.

8. The kit of claim 7 with Velcro attached to the back of the badge holder.

9. The kit of claim 6 with Velcro attached to the back of the base of the clip.

* * * * *